US005153586A

United States Patent [19]

Fuller

[11] Patent Number: 5,153,586

[45] Date of Patent: * Oct. 6, 1992

[54] PARKING STALL MONITOR

[75] Inventor: Kip L. Fuller, Denver, Colo.

[73] Assignee: Innovision Technologies Group, Inc., Denver, Colo.

[ * ] Notice: The portion of the term of this patent subsequent to Mar. 13, 2007 has been disclaimed.

[21] Appl. No.: 492,790

[22] Filed: Mar. 13, 1990

Related U.S. Application Data

[63] Continuation-in-part of Ser. No. 192,346, May 10, 1988, Pat. No. 4,908,617.

[51] Int. Cl.[5] ..... G08G 1/14

[52] U.S. Cl. ..... 340/932.2; 368/90; 364/464.01

[58] Field of Search ..... 340/932.2, 943; 364/464.01, 467; 194/900, 902; 49/49; 368/90, 92

[56] References Cited

U.S. PATENT DOCUMENTS

| | | | |
|---|---|---|---|
| Re. 20,764 | 6/1938 | Babson | 340/932.2 |
| 3,015,087 | 12/1961 | O'Gorman | 340/543 X |
| 3,324,647 | 6/1967 | Jedynak . | |
| 3,376,547 | 4/1968 | Auer, Jr. | 340/932.2 |
| 3,999,372 | 12/1976 | Welch et al. | 368/90 X |
| 4,043,117 | 8/1977 | Maresca et al. | 368/90 X |
| 4,356,903 | 11/1982 | Lemelson et al. | 340/932.2 X |
| 4,861,971 | 8/1989 | Chan | 368/90 X |
| 4,908,617 | 3/1990 | Fuller | 340/932.2 |

*Primary Examiner*—Jin F. Ng
*Assistant Examiner*—Brian R. Tumm
*Attorney, Agent, or Firm*—Wood, Herron & Evans

[57] ABSTRACT

A parking stall monitor located adjacent a restricted use parking stall detects vehicle presence in the parking stall and activates an alarm to provide a warning in response thereto. A disarm/arm circuit associated with the monitor generates a coded input in response to receipt of an identification signal from an authorized user, thereby to disarm either the detector or the alarm to enable the vehicle of the authorized user to occupy the parking stall without a warning being provided. Subsequently, when the authorized user is ready to leave the parking stall, receipt by the disarm/arm circuit of another identification signal, or removal of the initial identification signal, causes the monitor to rearm. The identification signal may be produced nonautomatically or automatically, either actively or passively, and the capability of originating this signal serves to distinguish a selected group of authorized users from those not permitted to use the stall.

9 Claims, 10 Drawing Sheets

PARKING STALL MONITOR

This application is a continuation-in-part application based on Ser. No. 192,346, filed on May 10, 1988 and entitled Parking Stall Monitor, issued as U.S. Pat. No. 4,908.617.

FIELD OF THE INVENTION

This invention relates to a parking stall monitor which provides an audible warning upon detecting the unauthorized presence of a vehicle in a reserved parking stall.

BACKGROUND OF THE INVENTION

As explained in the parent application, it is common to designate certain particularly convenient parking locations or stalls for a designated individual, i.e., a president of a company, or a select group of individuals, i.e., handicapped individuals. Such designation can be accomplished by a written notice, constituting either an upright sign or indicia printed in or adjacent the parking stall. However, absent costly around-the-clock human surveillance, a printed notice of restricted use seldom sufficiently deters all unrestricted uses of a parking stall.

Prior attempts to control access to a restricted use parking stall have included the use of a retractable barrier which is remotely controlled by either a radio or a coin operated device accessible to the driver of the vehicle to retract the barrier upon contact of the barrier by a wheel of the vehicle. Absent the proper signal, the barrier will block entry of a vehicle into the stall.

Such devices are bulky and cumbersome, requiring the erecting and maintaining of a retractable physical structure within the parking stall. In addition to the cost of installation, barrier monitors introduce an inconvenience with respect to maintaining an entire parking lot. For example, during a snow emergency, a plow is physically restricted from laterally traversing and clearing a large number of stalls in a short period of time.

It is therefore desirable to provide a cost-effective parking stall monitor which effectively prevents unauthorized use of a parking stall, yet does not require the erection and maintenance of a barrier within the stall.

SUMMARY OF THE INVENTION

To these ends, according to a preferred embodiment of this invention, a parking stall monitor located adjacent to a parking stall includes a vehicle presence sensing circuit that detects the presence of a vehicle in the stall, an alarm that provides a warning in response to detection of vehicle presence, a clock circuit that provides a time delay between detected presence and activation of the alarm, and an arm/disarm circuit adapted to receive a signal from selectively possessed identification means, and in response thereto, to generate a coded input to disarm either the detector or the alarm in order to enable an authorized vehicle to occupy the stall without a warning being provided. Subsequently, when the authorized vehicle is ready to leave the stall, the signal from the selectively possessed identification means rearms the monitor, thereby providing selective disarming and arming of the monitor to enable an authorized vehicle to occupy the stall without a warning being provided.

According to one embodiment, the presence detector is adapted to transmit energy in the form of a short burst of ultrasonic pulses in the direction of the parking stall, and then after a predetermined time interval, to detect during a time window of predetermined duration the reflection of the transmitted energy off of a vehicle located in the stall. The use of the time window and time duration are chosen so as to ensure that a detected object is actually located within the stall.

Alternately, vehicle presence may be detected by a directional microphone mounted on the monitor, the microphone adapted to detect the engine noise of a vehicle located in the stall.

Upon detecting the presence of a vehicle within the stall, the vehicle presence sensing circuit keys the clock circuit, which signals the alarm circuit. The alarm circuit provides an audible warning, preferably a verbal warning, that use of the stall is unauthorized and the vehicle will be towed if not removed from the stall. If desired, the detector may directly activate the alarm, with the clock circuit then keyed by the alarm.

Either way, the clock circuit preferably provides a time delay after presence detection but before either activation of the alarm or actual issuance of the warning. The delay is sufficient in duration to enable disarming to take place. The delay must be sufficient to enable the driver of an authorized vehicle to pull into the stall and get out of the vehicle to disarm the monitor before the warning is provided. Similarly, after authorized parking, there is also a time delay of sufficient duration to enable rearming of the monitor without a warning. The time delay before keying of the alarm circuit and/or actual providing of the alarm must be sufficient to permit the driver of the authorized vehicle to get back into the car and drive away before a warning is provided. The duration of the time delay may vary according to the particular manner or mode of generating the coded input, or the manner of receiving a signal from the selectively possessed identification means.

The arm/disarm circuit is operatively connected with at least one of the clock circuit, the vehicle presence sensing circuit and the alarm circuit, and is responsive to an input generated at the monitor in response to a signal initiated by an authorized driver and/or authorized vehicle in possession of selectively possessed identification means, which may be a transmitter, a key card, a number to enter into a keypad, a reflector or an absorber mounted on the vehicle, etc. Only those "selected users" or authorized drivers and/or authorized vehicles in possession of the selectively possessed identification means will be accepted and recognized for parking in the stall without the providing of a warning signal by the monitor. If desired, the monitor may be receptive to a number of different selectively possessed identification means to achieve disarming/arming, thus enabling the user to choose the most convenient of the available modes. Generally, a time delay of relatively shorter duration is sufficient for a mode utilizing a transmitter.

In addition to these "non-automatic" modes of disabling, or disarming, the monitor, an "automatic" mode may be utilized for disarming and/or rearming the monitor, as will be discussed in more detail in the detailed description. Preferably, receipt of the disarm signal is indicated by a red indicating light mounted on the monitor, and receipt of an arm signal is indicated by a green indicating light mounted on the monitor.

The audible warning can vary according to preference. In one embodiment of this invention, the monitor is programmable to allow an authorized user to select a desired alarm sequence, including a desired verbal warning.

If desired, the alarm circuit can also transmit a warning signal in the form of an RF signal to a central location such as a secretary's office, in order to provide immediate notification of unauthorized use. Alternatively, at the central location, the reception of the signal can be used to activate an automatic dial telephone line to summon a tow truck. For this modification, the signal transmitted to the central location would preferably be coded to correspond to a particular parking stall.

The parking monitor of this invention provides effective, unsupervised monitoring of a restricted use parking stall, while alleviating the need to construct and maintain a barrier in the stall to physically block unauthorized access to the stall.

According to one preferred embodiment of the invention, the monitor is mounted in the ground within the stall. When a vehicle pulls into the parking stall, the vehicle depresses a stantion to manually close a switch that will activate a siren and a warning after a five second delay. An authorized vehicle is equipped with a short range radio transmitter, preferably attached to the battery, which sends a signal to a receiver in the monitor to deactivate the siren and the warning before the five second delay period has expired. The transmitter transmits the signal continuously during authorized parking, i.e., at least once every five seconds during parking, and as long as this signal is received, the siren and warning circuits remain deactivated. When the authorized vehicle leaves the space, the spring-loaded stantion returns to an upright position to open the switch that activates the siren and voice circuits so that the circuits are in a "ready" condition for the next vehicle that enters the stall.

This invention could also be adapted for advantageous use at a shipping or loading dock. With each of the vehicle spaces of the dock equipped with a parking stall monitor in accordance with the invention, entry of a truck into a space will be detected and an alarm activated. The alarm alerts a foreman that a vehicle is present in one of the spaces. If desired, the alarms can be coded to indicate a particular space. If the truck is authorized to occupy the space, the foreman can disarm the alarm. In this application of the invention, as long as a foreman at the parking space determines whether or not a vehicle is authorized, there is no need to provide the time delay before activation of the alarm circuit and/or providing the warning.

These and other features of the invention will be more readily understood in view of the following detailed description and the drawings in which:

DETAILED DESCRIPTION OF THE DRAWINGS

Figure 1:
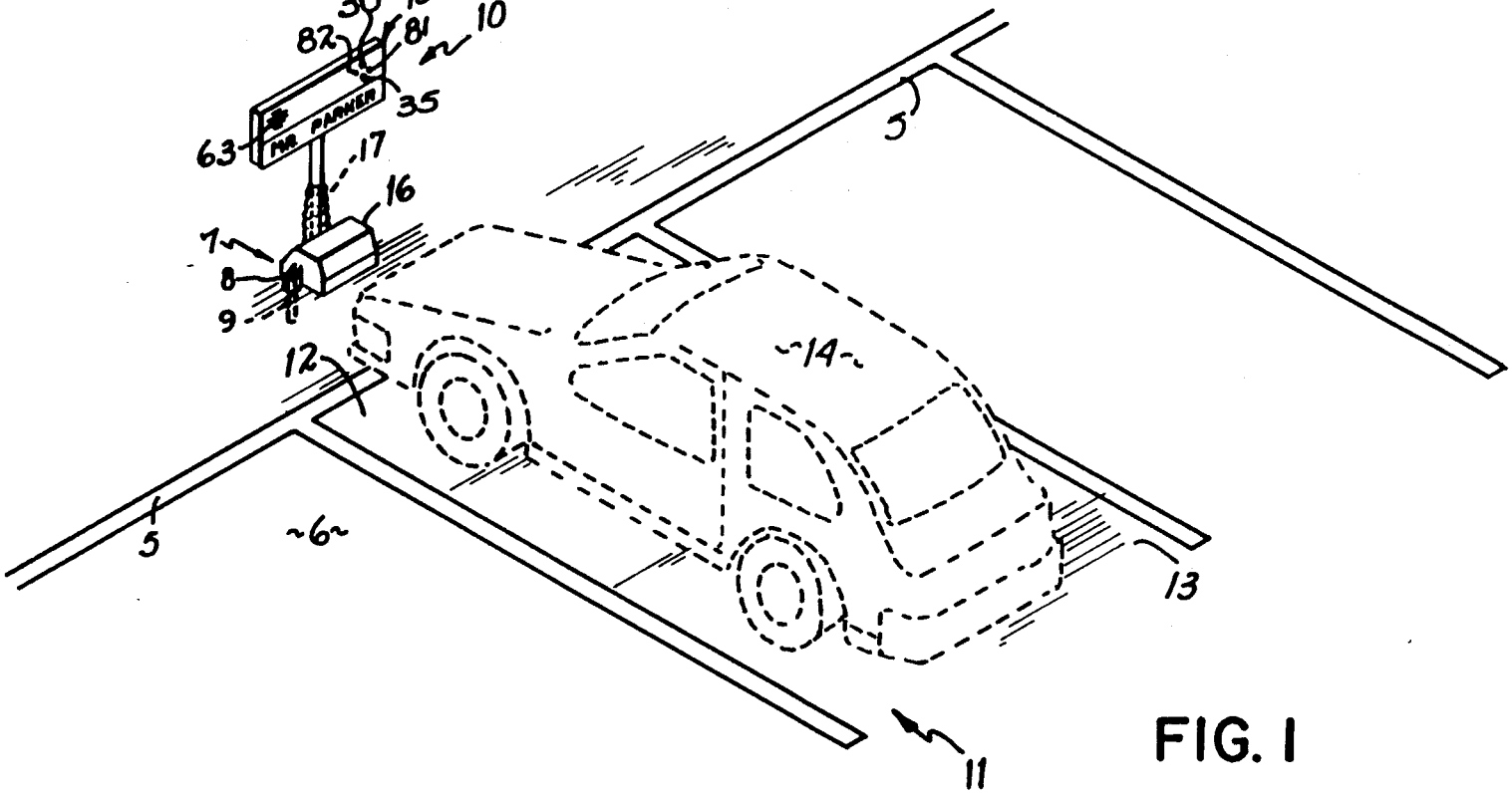
FIG. 1 is a perspective view of a parking lot with a preferred embodiment of the parking stall monitor of this invention mounted adjacent a restricted use parking stall.

According to a preferred embodiment of the invention, as shown in FIG. 1, a parking stall monitor 10 is located outside of, but adjacent a restricted use parking stall 11 which is delineated by painted borders 5 on a parking surface 6. The monitor 10 resides adjacent a first end 12 of the stall 11, which lies opposite, and is spaced from, a second end 13 that is used for entry and exit of a vehicle 14. Preferably, the parking monitor 10 comprises a housing 15 flexibly mounted to a base 16 by a hollow, yieldable assembly 17.

In a preferred embodiment, a surface of the housing 15 facing the stall 11 bears some indicia, i.e., a name or a warning, to indicate restricted use of the stall 11. The yieldable assembly 17 includes a spring to provide some degree of flexibility between the housing 15 and the base 16 in order to minimize damage in the event that the vehicle 14 strikes the monitor 10. The base 16 carries a captive female threaded tamper resistant fastener 7 on an ear 8 projecting from each side thereof. Each captive fastener 7 engages a threaded portion of a respective exteriorly threaded stud 9 embedded within and projecting a sufficient distance above the parking surface 6. The housing 15 contains most of the circuitry for the monitor 10 while the base 16 preferably houses the power supply, thus providing ground support for most of the weight of the monitor and increasing overall stability. The power supply preferably comprises two 6-volt lantern batteries. Two Eveready alkaline batteries sold as Part No. NEDA908A have proved suitable.

Figure 2:
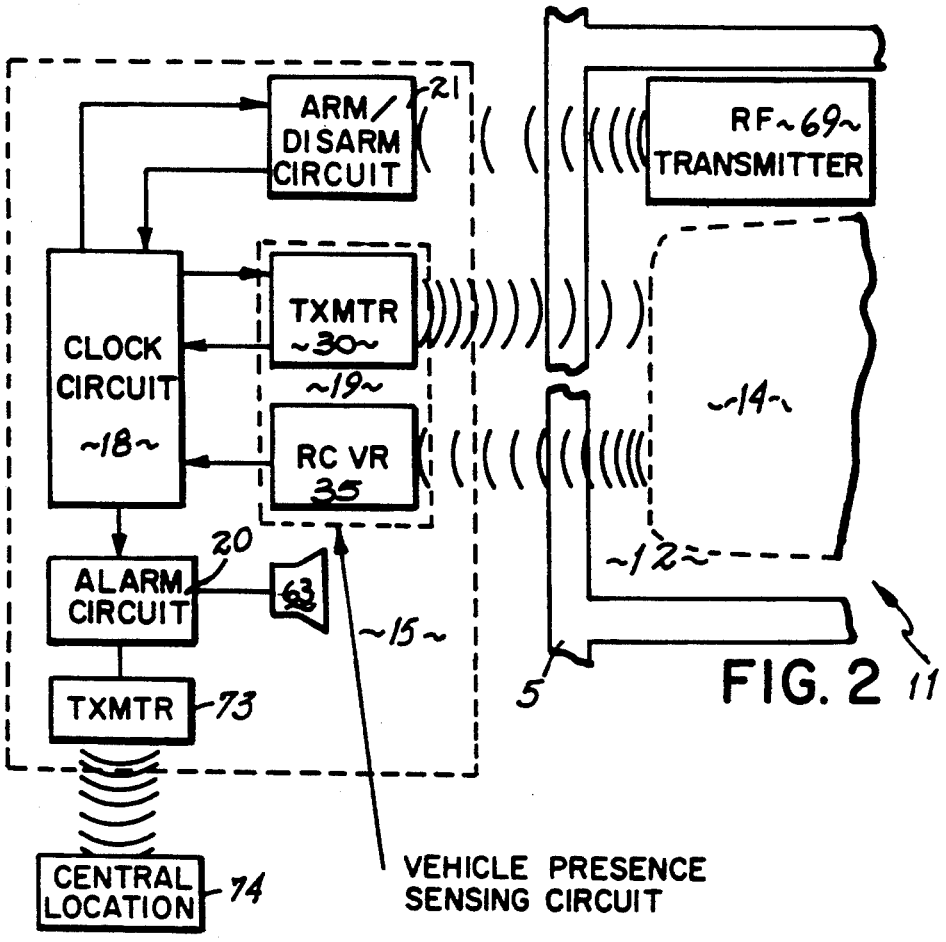
FIG. 2 is a block diagram which illustrates the operation of a parking stall monitor according to a preferred embodiment of this invention.
Figure 4:
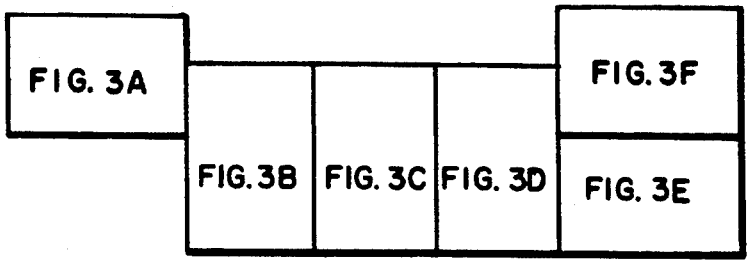
FIG. 4 shows the relative positioning of FIGS. 3A–3F necessary to provide an entire circuit schematic of a parking stall monitor according to a preferred embodiment of the invention.

According to a preferred embodiment of the invention, and shown in block form in FIGS. 2 and schematically in FIGS. 3A–3F, a clock circuit 18, a vehicle sensing circuit or detector 19, an alarm circuit 20 and an arm/disarm circuit 21 reside within housing 15.

The clock circuit 18 provides all of the timing signals which control the sequences of operation for the other circuits. As shown in FIG. 3B, the output of a 32.768 KHz crystal oscillator is input into time divider 22, and into time divider 23 via time divider 22 to provide the time base for the clock circuit 18. Each of the time dividers has outputs numbered Q1 through Q12. The output of Q1 is at a frequency which is halved from the CLK input, and each of the numbered outputs provides a signal which is halved with respect to the next adjacent output above it.

In one preferred sequence of operation, the sequence programmed to repeat every second, a signal from a flip flop 24 (FIG. 3C) within the clock circuit 18 over line 26 turns on a transistor 29 (FIG. 3D) in the vehicle sensing circuit 19 to provide power to a transmitter 30 and the rest of the presence sensing circuit 19 via the PWR connection. The signal from flip flop 24 also resets another flip flop 27 (FIG. 3C) via line 28 at the same time that transistor 30 is turned on.

While transistor 29 is on, transmitter 30 transmits ultrasonic signals into the stall 11 which are created by an oscillating circuit 31 at about 44 KHz. After a first time interval of about 1.5 milliseconds, a signal from the clock circuit 18 to the vehicle sensing circuit 19 over line 33 turns off the transmitter 29. Because the transmitting circuitry takes about 0.8 milliseconds to warm up, the burst of audio pulses lasts about 0.7 milliseconds.

The vehicle sensing circuit 19 is keyed by the clock to look for these reflected pulses during a second time interval, which is a time window of predetermined duration staggered in time after the first interval. Staggering of the first and second time intervals assures that no interference will occur as a result of simultaneous transmitting and receiving. The duration of time stagger between the first and second intervals is chosen to correspond to a sound wave traveling a maximum of 6 feet into the parking stall and 6 feet back towards the housing. The time stagger and the second time interval are timed such that reflected pulses will not be detected off of a vehicle in an area outlying the stall.

A receiver 35 (FIG. 3D) senses any of the ultrasonic pulses that are reflected back toward the housing 11 from an object within the stall. Reception of reflected signals by receiver 35 will cause the output of transistor 36 to go low, providing a low signal over line 37 to one input of a NOR gate 38 in the monitor. The other input of the NOR gate 38, connected to the $\overline{Q}$ output of flip flop 27, goes low about 3.9 milliseconds after the transistor 29 is initially turned on.

Thus, reflected signals are sensed during a time window which begins about 3.9 milliseconds after initial powering of the sensing circuit 19, with about a 2.4 millisecond delay between the end of pulsed ultrasonic transmission and the sensing of reflected pulses. Sensing of reflected signals is possible so long as flip flop 27 remains low, which will be for a duration of about 11.7 milliseconds, or until about 15.6 milliseconds have elapsed from the time of first turning on transistor 29. This is sufficient time for a sound wave to travel into the stall reflect off of an object within the stall, and return to the housing.

If no pulses are received at gate 38, flip flops 42 and 43 are not reset, and flip flop 44, connected to the Q output of flip flop 43, will periodically reset the time divider 23 via a signal from its Q output over line 46. The time divider 23 will be reset by flip flop 44 at a frequency such that a flip flop 47 (FIG. 3B) connected to Q4 and Q5 of time divider 23, never activates the alarm circuit 20.

With both inputs to NOR gate 38 low, two flip flops, 42 and 43, respectively, are reset. When flip flops 42 and 43 are reset, and the Q output of flip flop 43 fed into flip flop 44, the $\overline{Q}$ output of flip flop 44 will go high, transmitting a signal over line 50 which will eventually activate the alarm circuit 20. In the absence of a reset signal over line 46, the clock circuit 18 activates the alarm circuit 20 via outputs Q4 and Q5 from time divider 23. Outputs Q4 and Q5 are fed into flip flop 47 which turns on a JFET 48 to ground a floating ground 49. The components of the alarm circuit 20, for the most part shown in FIGS. 3E and 3F, become operative when the floating ground 49 is pulled low. JFET 48 remains on for a duration of 36 seconds, set by timer 51, so long as the $\overline{Q}$ output of flip flop 44 remains high.

According to the alarm sequence depicted in FIGS. 3A-3F, after the alarm circuit has been activated, the clock 18 provides a four second delay, followed by a four second audible siren, followed by a one second delay which is then followed by an eight second verbal message such as "warning, move your car or it will be towed." After a one second delay, the sequence picks up at the four second siren to repeat one more time before ending with another one second delay followed by a four second siren.

The signal to activate non-verbal audible warning is carried over line 54 into a buffer 52. A signal on line 56, which activates the verbal warning circuitry, disables the non-verbal alarm signal on line 54 via NOR gate 58, thus preventing simultaneous verbal and non-verbal warnings. Signals over lines 61 and 60 out of buffer 52 activate the circuitry (shown in FIG. 3E) for providing verbal and non-verbal warnings, respectively, which are amplified and eventually emitted through a speaker 63 (FIG. 3F). Interruption of the "vehicle presence sensed" signal prior to the siren will cause the clock circuit 18 to disable the alarm circuit 20 via a signal on line 50.

The verbal warning is provided by a PROM 64 which provides an output to a digital-to-analog converter 65 that is input to the speaker 63. The PROM 64 may store multiple messages which are selectable by the operator. Alternatively, interchangeable PROMs 64 could be used to enable greater variation in selection of an appropriate message. If desired, one or more additional message storage devices may be added to or used to replace the PROM 64 verbal warning circuit so that an authorized user may record, and later select, one or more of his or her own personalized verbal messages. A voltage regulator 66, shown in FIG. 3E, provides an operating voltage of 5 volts d.c., for all the components of the monitor 10, except those otherwise marked as +12V or PWR.

The arm/disarm circuit 21 enables authorized use of the parking stall without setting off the alarm. A timer 67 in the arm/disarm circuit 21 is keyed by the Q12 output of time divider 22 via line 68 to look for a signal from a hand held transmitter 69 carried by an authorized user. Similar to a hand held device used to operate an electronic garage door opener/closer, the hand held transmitter 69 transmits an encoded RF signal to activate or deactivate the arm/disarm circuit 21. If the parking monitor 10 is armed, an encoded RF signal from the transmitter is received by a receiver circuit, shown above directional arrows 70, decoded by a decoder 71 and fed into an AND gate 76 which is connected to the B7 output of timer 67. The receiver is tuned to a carrier frequency of about 300 MHz.

When a pulsed signal from timer 67 is received, assuming the monitor is "armed", the high $\overline{Q}$ output from flip flop 77 is transmitted via line 78 to hold the Q output of flip flop 44 in a high state, thus preventing the clock 18 from keying the alarm 20 and "disarming" the monitor. The $\overline{Q}$ output of flip flop 77 also turns on a red light emitting diode 81 to indicate the disarmed condition.

Similarly, the next encoded RF signal transmitted by the transmitter 69 to the arm/disarm circuit 21 will cause the $\overline{Q}$ output of flip flop 77 to go low. The low signal transmitted over line 78 will enable the Q output of flip flop 44 to go low, thus "rearming" the monitor.

The Q output of flip flop 77 will activate a green light emitting diode 82 to indicate the rearmed condition. To save power, the respective light emitting diodes will blink for a duration of about eight seconds whereupon a signal from timer 67 will turn them off.

The integrity of the monitoring system is assured by the use of encoded transmitted RF signals to change the state of the arm/disarm circuit 21. The transmitter 69 is coded according to an eight bit binary number to transmit a series of either long or short pulses on a carrier of about 300 MHz. The arm/disarm circuit 21 is set to decode only an eight bit series of pulses corresponding in duration to those transmitted from a similarly coded transmitter 69. As mentioned previously, and as depicted in FIG. 2, a warning signal can be transmitted from a transmitter 73 located at the monitor 10 to a remotely located central location 74.

Figure 5:
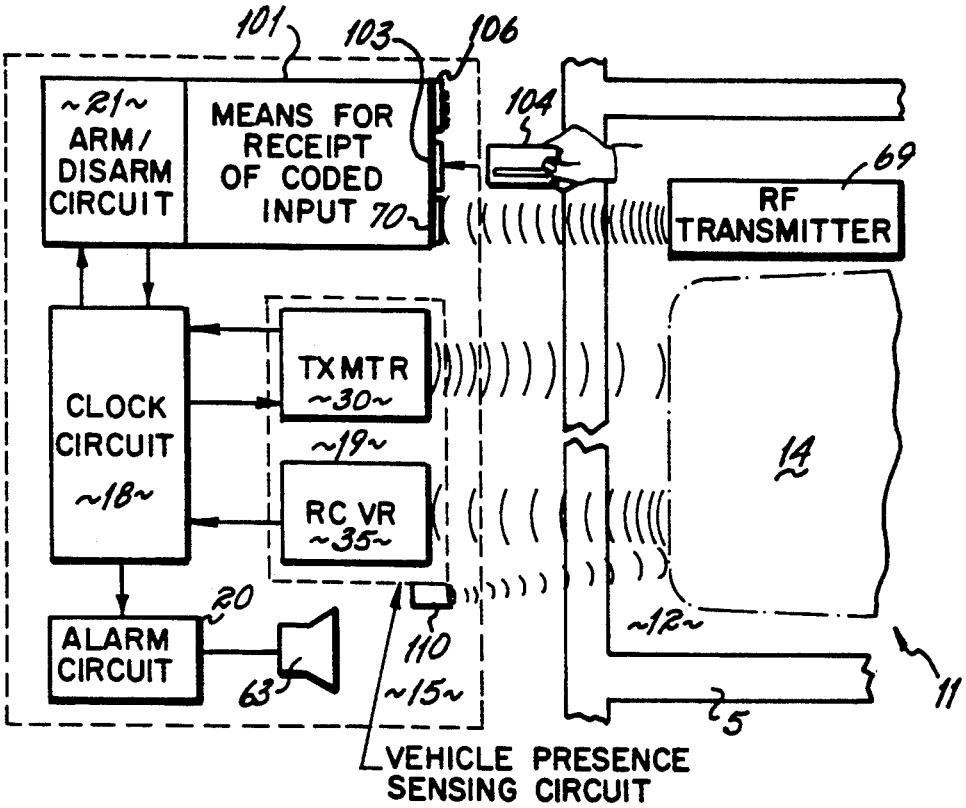
FIG. 5 is a schematic similar to FIG. 2 which depicts two alternative modes for disarming and arming the monitor, along with an alternative embodiment for detecting vehicle presence in the stall.

In accordance with several alternative embodiments of the invention, as shown in FIG. 5, the arm/disarm circuit 21 may more broadly be described as adapted to receive a coded input 101 instead of, or in addition to, the encoded signal from a transmitter 69. It is the use of a coded input which assures the integrity of the system. The coded input may be provided by one of any number of methods. For instance, the coded input 101 may be received by a coded card reader 103, with selective disarming and arming taking place upon insertion of a coded card 104 by an authorized user. Another alternative mode for arming and disarming the circuit 21 involves the use of a keypad 106. The keypad 106 is adapted to receive the coded input in the form of a preselected, predetermined alphanumeric sequence or code which is keyed in by an authorized user in order to selectively disarm and arm the monitor 10. The authorized user will most probably be the driver of the vehicle, although this is not absolutely necessary, as evidenced by the loading dock example described in the summary.

Figure 3A:
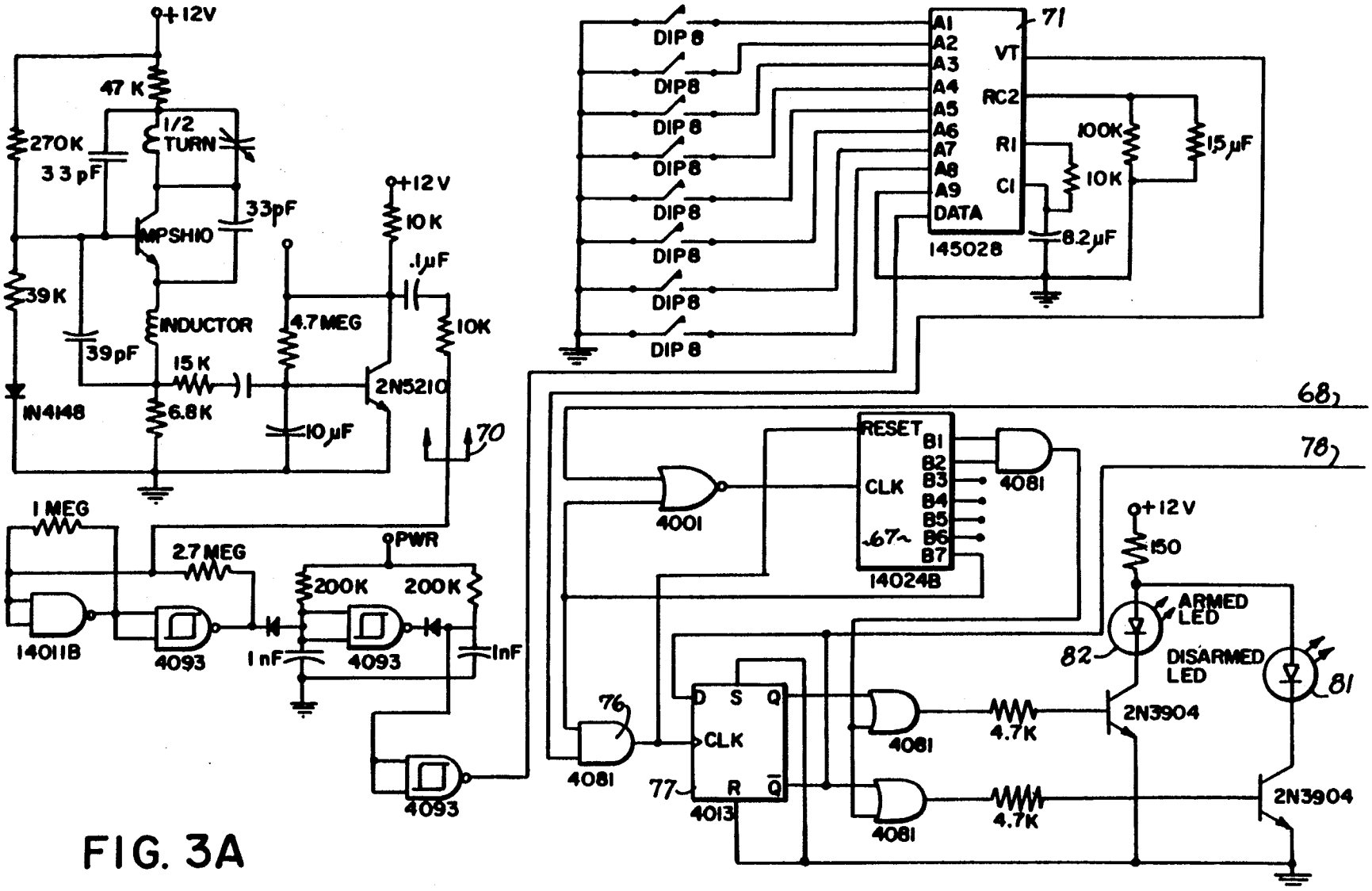
FIGS. 3A–3E show circuit schematics for the clock circuit, the vehicle presence sensing circuit, the alarm circuit and the arm/disarm circuit according to a preferred embodiment of the invention.
Figure 3B:
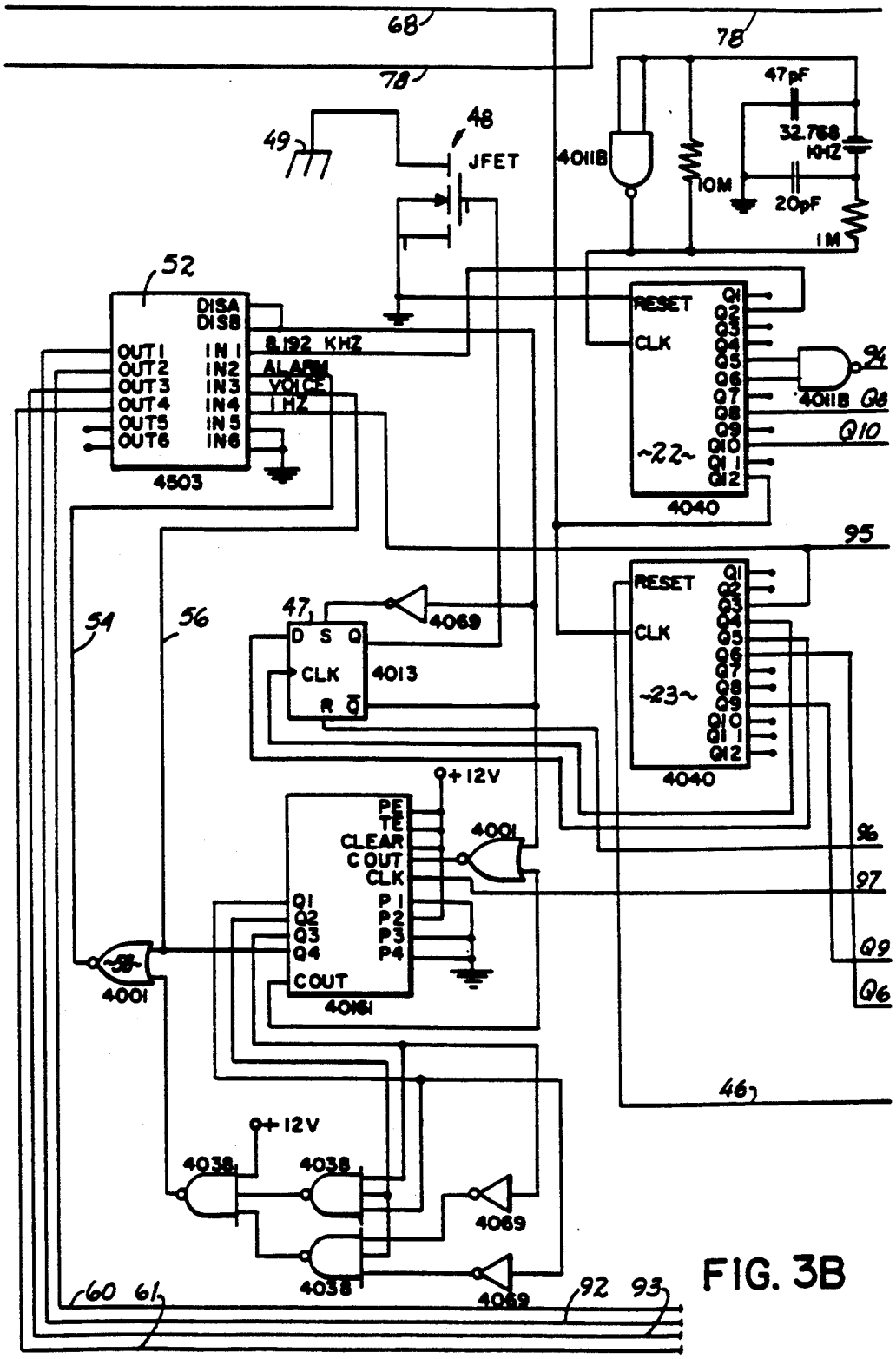
Figure 3C:
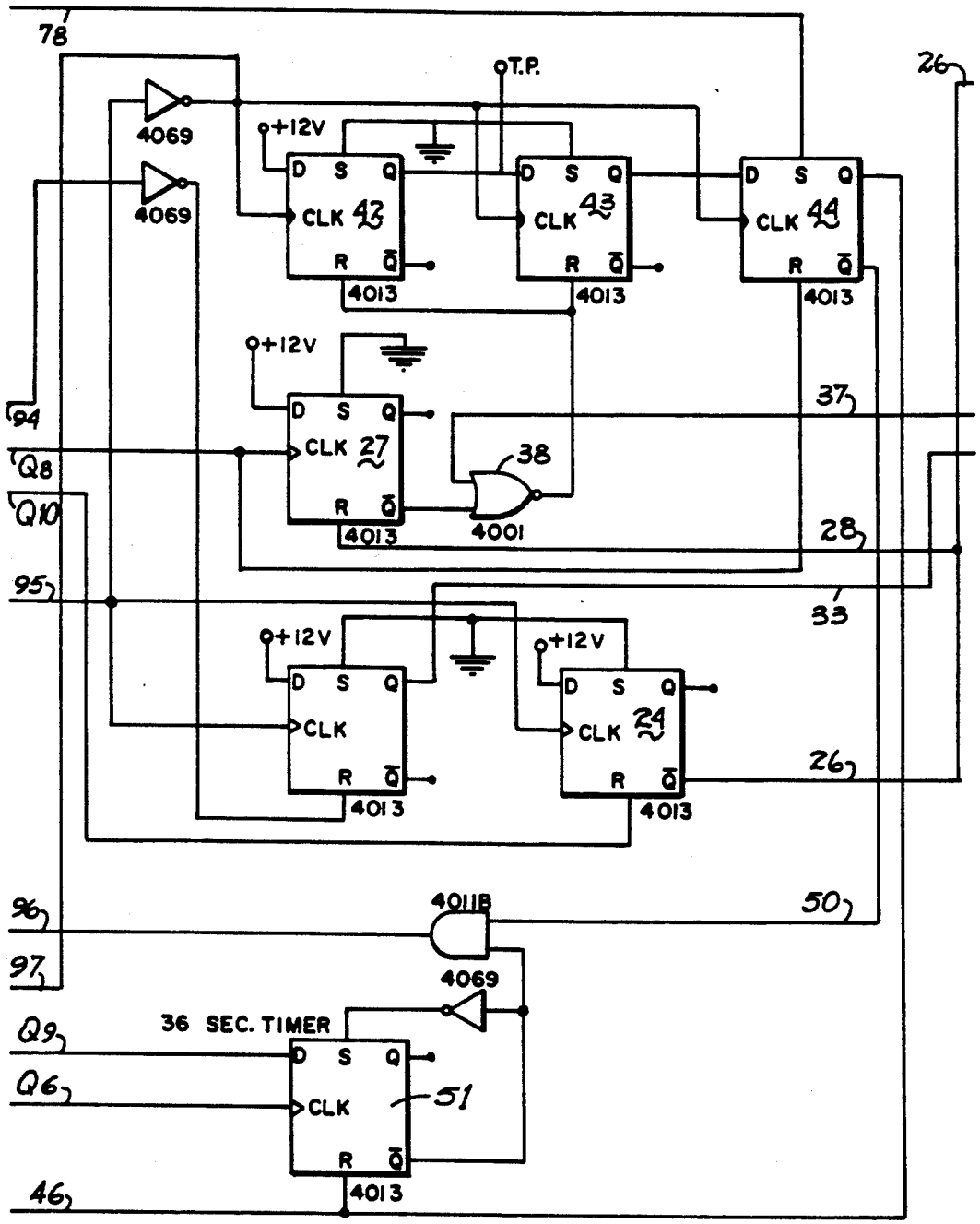
Figure 3D:
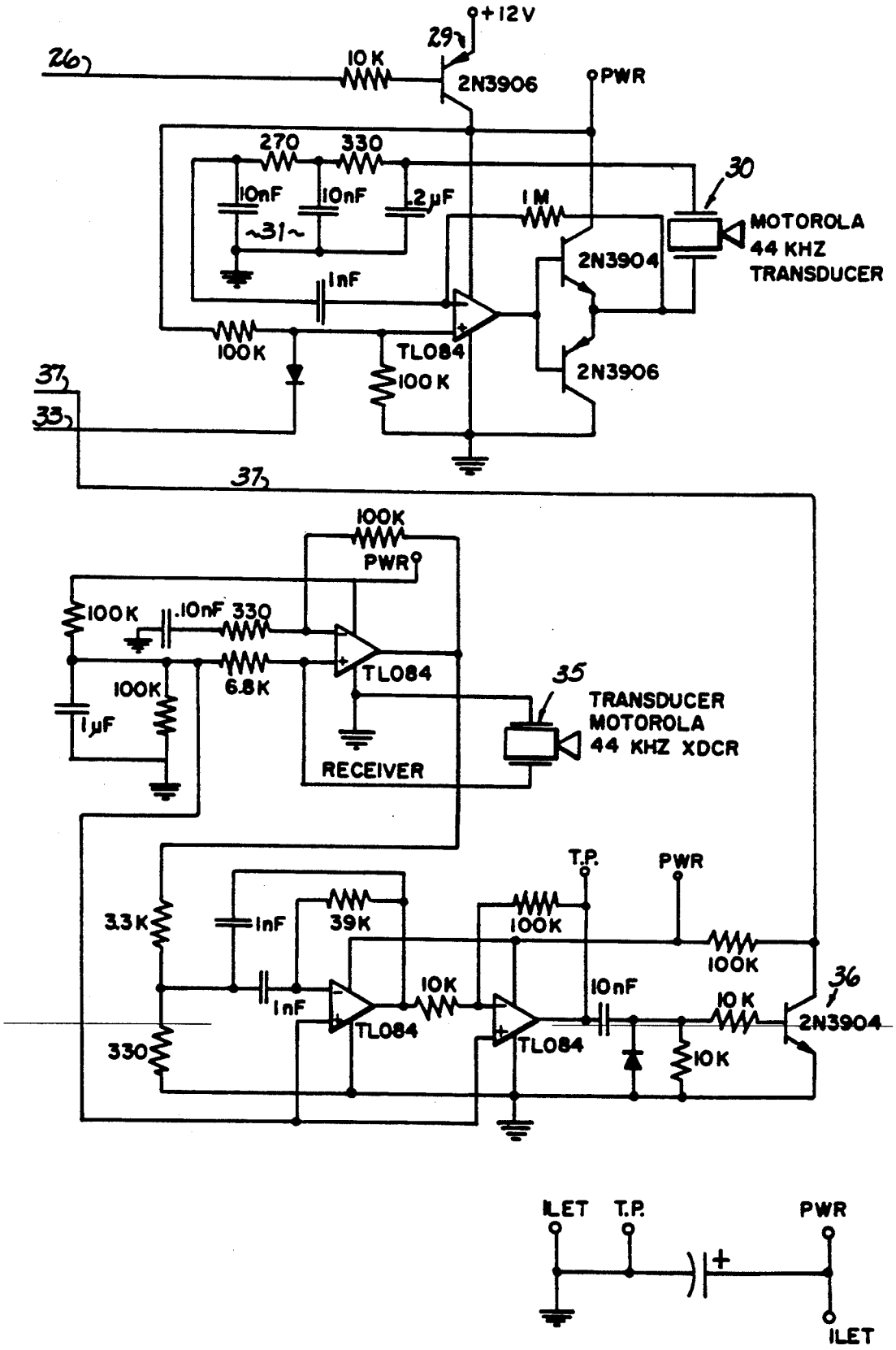
Figure 3E:
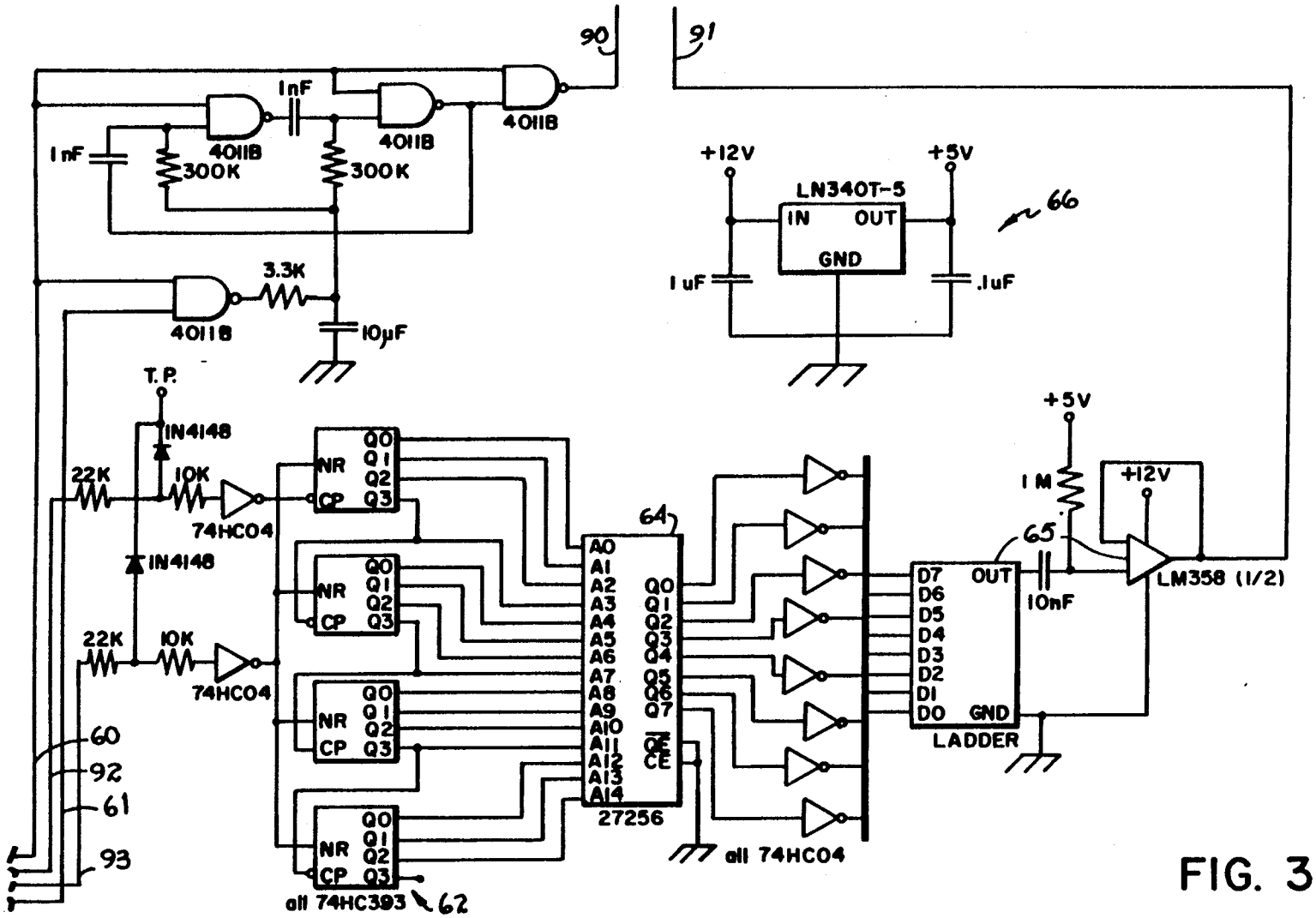
Figure 3F:
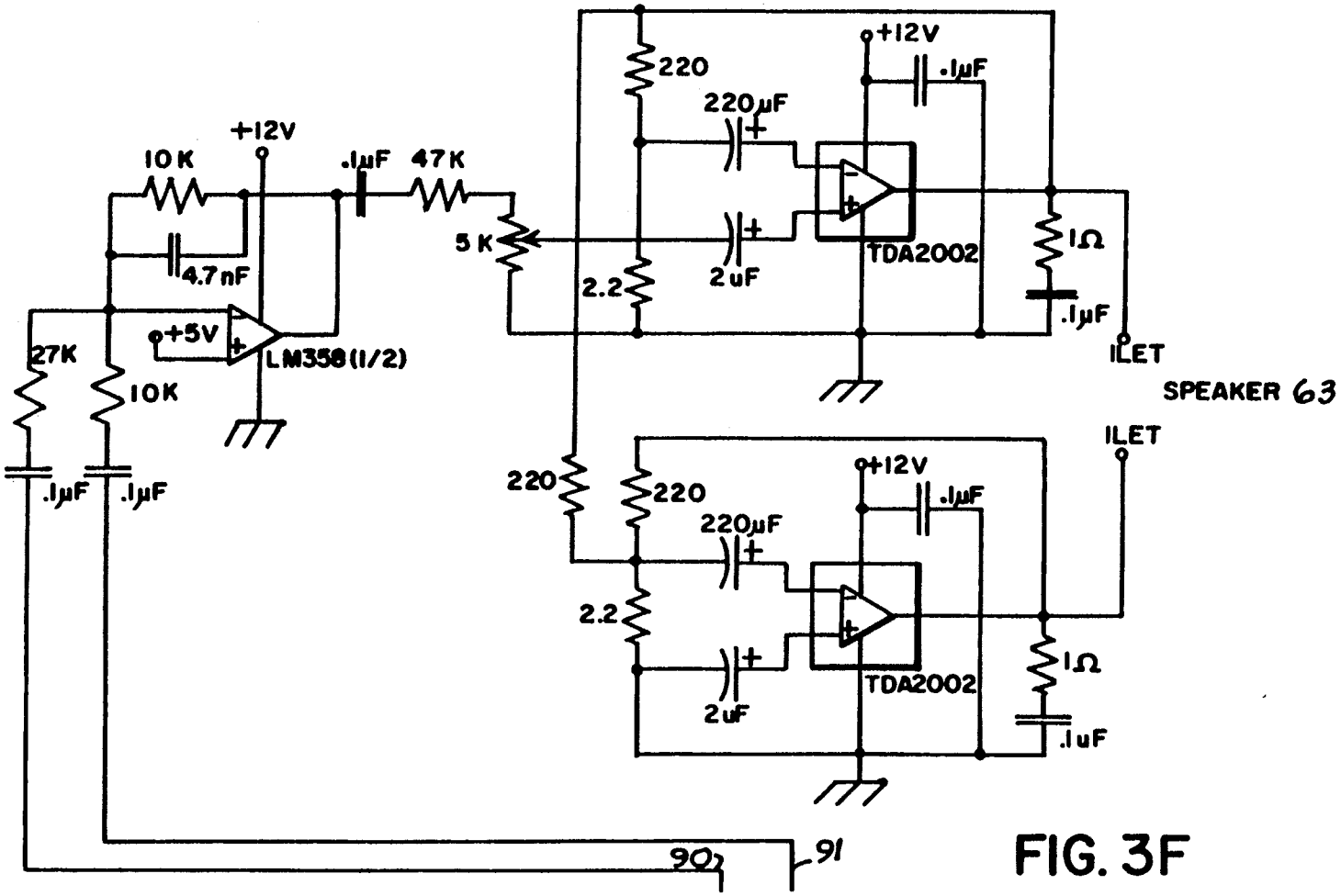

If either of these alternative modes is to be used alone, the coded input received by either the reader 103 or the keypad 106 must be fed into the DATA input of decoder 71 shown in FIG. 3A. If the authorized user is to select one of the three modes of disarming and arming, including transmission of an encoded RF signal by transmitter 69 and generation of the coded input by a receiver circuit 70 in response thereto, each of the three coded input receiving means, i.e., the reader 103, the keypad 106 and the receiver shown in FIG. 3A, must be ORed together and the output connected to the DATA input of decoder 71.

If the monitor 10 employs either the coded card reader 103 or the keypad 106, or both, an additional time delay is preferably incorporated into the system, as described earlier. This time delay enables a driver of an authorized vehicle 14 to drive into the stall 11, get out of the vehicle and either insert the card 104 into the reader 103 o enter the preselected code into the keypad 106 to disarm the monitor 10 before the alarm 20 is actuated. At the end of authorized parking, the time delay enables the driver to rearm the monitor 10 and then get back into the vehicle 11 and drive away before the warning signal is provided. The time delay may be incorporated into clock circuit 18 and may be activated by a signal routed from the keypad 106, the reader 103, or both, via an OR gate. The duration of the time delay is preferably about 30 seconds for these two modes. It is assumed that a time delay of significantly less time would be sufficient for the transmitting/ receiving mode, and that an input to the clock 18 to provide this time delay could be routed separately from the keypad 106 and the reader 103 inputs.

FIG. 5 also shows an alternate manner of detecting vehicle presence in the stall 12. This alternative involves the use of a microphone 110, preferably a directional microphone, mounted to the monitor 10 to detect the presence or absence of engine; noise from a vehicle located in the stall 12. If desired, the microphone 110 may be powered periodically, in a manner similar to the audio transmitter 19.

While the preferred embodiments of the invention have been described in connection with a self-contained housing or unit that is located exteriorly of the parking space adjacent the forward end where the leading end of the vehicle is typically located, other variations coming within the spirit and scope of the invention are possible. For example, the self-contained monitor with warning sign, vehicle sensor and alarm could be located on the boundary line between adjacent parking spaces disposed opposite either the passenger or the driver's door. If this approach were utilized, the transmitter would be directing energy transversely across the parking stall, whereas in the preferred embodiment the energy transmitted is in a direction lengthwise of the parking stall.

In accordance with a further possible variation the presence detector could take the form of a metal detector such as an inductive loop that is embedded in the ground within the parking stall. The inductive loop could be connected to a sensor located in the monitor at a point outside the parking stall adjacent the position the front end of a vehicle occupies when parked in the stall, such as shown in FIG. 1, in a monitor located on the boundary between adjacent stalls as described immediately above, or even in a unit mounted or embedded in the ground within stall itself.

In addition to an inductive coil, a mechanical tredle switch or a spring loaded stanchion and switch located on the ground at the entry/exit end of the parking stall could also be provided. As a further alternative, an energy transmitter embedded in the ground in the parking stall and directing energy vertically upwardly in combination with an energy sensor for receiving energy reflected downwardly from the bottom of the car could be provided.

Finally, and as a still further alternative vehicle sensing means, vertical posts could be provided on the boundaries between adjacent parking stalls. In accordance with this arrangement, for each parking stall, the post on one side thereof would be provided with an energy transmitter directed transversely across the stall and on the post associated with the other side of the stall an energy receiver would be provided for receiving transmitted energy. Upon entry of an automobile into the parking space the beam of energy transversely directed across the parking stall from one post to the other would be interrupted, indicating the presence of a vehicle.

Figure 6:
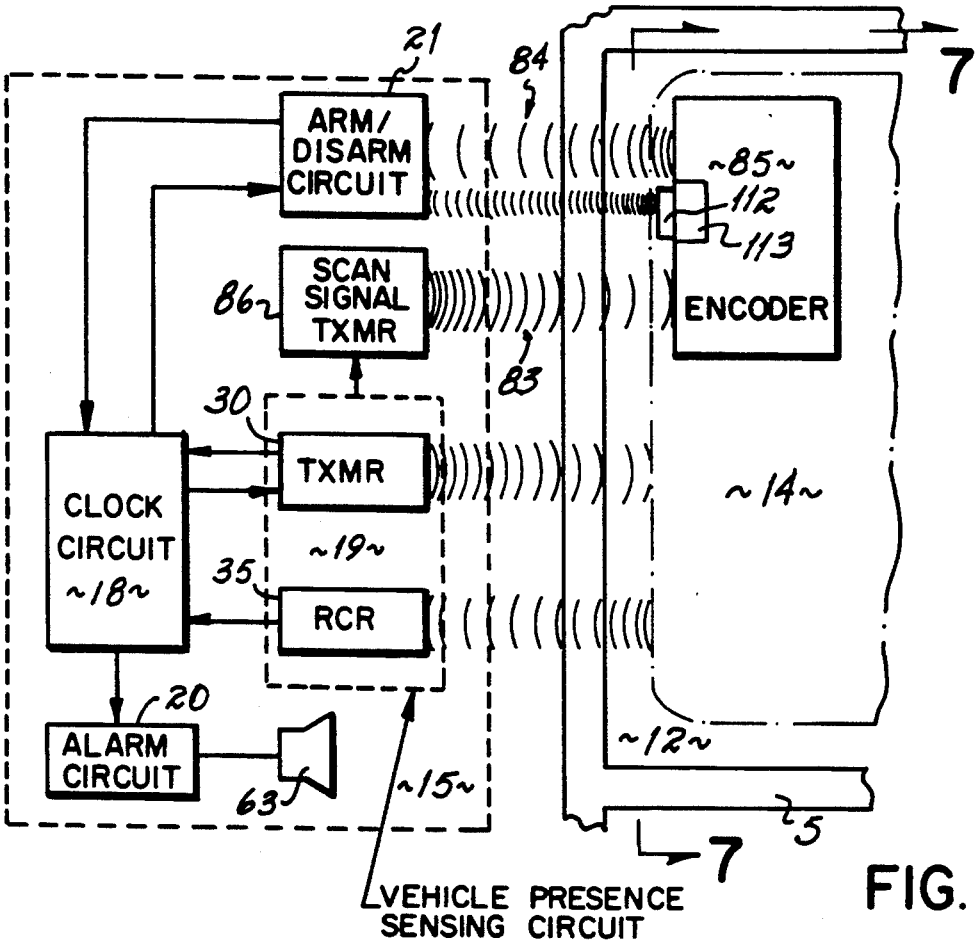
FIG. 6 is a block diagram which illustrates the operation of a parking stall monitor in accordance with an alternative, embodiment of the invention, the alternative embodiment involving automatic means for disarming/arming the monitor.

While the present invention has been described with respect to an arm/disarm circuit 21 in which the coded input is generated at the monitor in response to some manual or non-automatic operation by an authorized user in control of selectively possessed identification means, other variations within the spirit and scope of the present invention enable an authorized user in control of selectively possessed identification means to generate the coded input at the monitor automatically, either actively or passively. In an active automatic arm/disarm system, as shown in FIG. 6, in response to a scan signal 83 sent into the stall by the monitor upon detecting vehicle 14 presence in the stall 5, an authorized vehicle transmits an encoded signal 84 which is received and recognized by the monitor to disable the alarm during authorized parking. The system is referred to as "active" because the authorized vehicle must transmit for the duration of authorized use. Signal 84 is automatically transmitted by encoder 85 upon receipt of signal 83.

Alternately, no scan signal is used, and the authorized vehicle is equipped with a low power, periodically transmitting transmitter 112 that is removably connected to the battery 113. Receipt of this signal periodically disables either one of the detecting means or the warning means. While the transmitter 112 could transmit the signal continuously, battery 113 power can be saved if the signal is transmitted intermittently, or periodically. The vehicle is designated as one of perhaps a number of other vehicles that are "authorized" for parking in the stall simply because the transmitter is connected. This embodiment would also require some time delay between vehicle detection and providing of a warning signal, and the periodicity of the deactivating signal must be such that at least one signal is transmitted for every time delay. Otherwise, an undesired warning signal would result. If a directional microphone is used to detect vehicle presence, a "continuously" transmitting transmitter is preferred, so that engine noise of a vehicle from another stall does not inadvertently disarm the monitor. According to this embodiment, the monitor is not positively rearmed, the continuous disarm signal is simply removed when the authorized vehicle is driven away, and the monitor is ready to detect the next vehicle.

Figure 7:
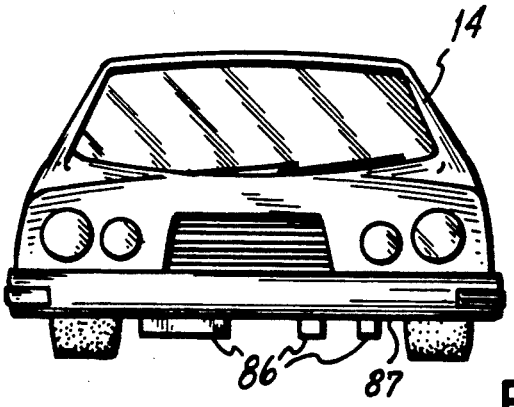
FIG. 7 is a cross sectional view taken along lines 7—7 of FIG. 6, showing vehicle modifications that are necessary to accommodate passive automatic disarming/arming of the monitor.

In a passive automatic system, an actively transmitting encoder 85 is not required. After detecting vehicle presence the monitor transmits a scan signal 83 into the stall which, upon recognizing a coded structural configuration of the car, i.e., a plurality of reflectors 86 extending from the bottom 87 of the chassis of the vehicle and spaced according to a predetermined, coded pattern, as shown in FIG. 7, the warning and alarm circuitry is inhibited. Thus, an authorized vehicle will not set off the alarm while it is in the stall. This system is referred to as "passive" because the authorized vehicle does not transmit anything but only reflects a predetermined code. Alternately, rather than reflectors, absorbers could be used. According to this embodiment, an absorber that absorbs a particular frequency is mounted to the bottom of an authorized vehicle. An unauthorized vehicle in the stall will reflect this frequency back to a receiver located in the ground within the stall, thereby causing a warning signal to be provided. In both the active and the passive automatic systems, the warning signal inhibiting mechanism is at least partially carried by the authorized vehicle.

In addition to automatic disarming/automatic rearming and non-automatic disarming/non-automatic rearming, it is also to be understood that the invention contemplates the possibility of non-automatic disarming in conjunction with automatic rearming, or vice versa. Thus, the terms "selective disarming" and "selective disarming and rearming" contemplate any manner, either automatic or nonautomatic, of accomplishing inhibition of the warning signal during authorized parking through use of selectively possessed identification means to generate the coded input at the monitor.

Ultimately, the monitor according to this invention enables an authorized driver and/or an authorized vehicle to use a monitored parking stall 5, while excluding unauthorized drivers and/or vehicles from use of the stall 5. The receipt of identification information, received either automatically or non-automatically, by the monitor 10 serves as the basis for distinguishing authorized drivers and/or authorized vehicles from unauthorized users. Only selected users are in possession of one or more of the selectively possessed identification means for causing a coded input to be generated at the monitor to prevent issuance of a warning. The term "selected user" refers generally to either an authorized driver or an authorized vehicle that controls the selectively possessed identification means, while the term "unauthorized user" refers to a driver/vehicle combination where neither the driver nor the vehicle possesses the selectively possessed identification means which permits disarming of the monitor.

While the above description constitutes a preferred embodiment of the parking stall monitor of this invention, it is to be understood that the invention is not limited thereby and that in light of the present disclosure of the invention, various other alternative embodiments will be apparent to a person skilled in the art. Accordingly, it is to be understood that changes may be made without departing from the scope of the invention as particularly set and claimed.

I claim:

1. A parking stall monitor for indicating unauthorized use of a parking stall comprising:

means for detecting the presence of a vehicle in said parking stall;

means for providing a warning signal upon detecting said vehicle presence;

a time operatively associated with said detecting means and said providing means and adapted to provide a time delay of predetermined duration after vehicle detection and before providing of said warning signal; and automatic means at least partially carried by an authorized vehicle for automatically disarming at least one of said detecting means, said timer and said providing means when said authorized vehicle is located in the stall, thereby to automatically enable an authorized vehicle to occupy said parking stall without said warning signal being provided.

2. The parking stall monitor of claim 1 wherein said automatic means for automatically disarming further comprises:

a transmitter carried by said authorized vehicle, said transmitter adapted to periodically transmit a deactivating signal to said monitor to deactivate one of said detecting means, said providing means and said timer, thereby to allow said authorized vehicle to occupy said parking stall without the warning signal being provided.

3. The parking stall monitor of claim 1 wherein said transmitter is adapted to transmit at least one deactivating signal during each time delay.

4. A method of indicating unauthorized use of a parking stall comprising the steps of:

detecting the presence of a vehicle in the parking stall;

providing a warning signal upon detection of said vehicle presence; and controlling selectively possessed identification means to inhibit one of said detecting and providing steps during parking of an authorized vehicle in the stall and to reactivate said one of said steps upon termination of parking of said authorized vehicle in the stall, thereby to enable the authorized vehicle to occupy the parking stall without said warning signal being provided.

5. The method of claim 4 wherein said controlling step further comprises: inhibiting said one of said steps substantially continuously throughout the duration of authorized parking.

6. The method of claim 4 wherein said presence detecting step is performed magnetically.

7. A parking stall monitor for indicating unauthorized use of a parking stall comprising:

means for detecting the presence of a vehicle in said parking stall;

means for providing a warning signal upon detecting said vehicle presence; and means for selective disarming and rearming of one of said detecting means and said providing means, thereby to enable an authorized vehicle to occupy said parking stall without said warning signal being provided, said selective disarming and rearming means including means for generating an input initiated by selectively possessed identification means, wherein said means for detecting includes a microphone adapted to sense engine noise of a vehicle located in the parking stall.

8. The parking stall monitor of claim 7 and further comprising:

a transmitter adapted to continuously transmit a disarm signal; and a receiver adapted to receive said disarm signal and to generate a coded input to disarm one of said detecting means and said providing means in response thereto.

9. A parking stall monitor for indicating unauthorized use of a parking stall comprising:

means for detecting the presence of a vehicle in said parking stall;

means for providing a warning signal upon detecting said vehicle presence;

means for selective disarming and rearming of one of said detecting means and said providing means, thereby to enable an authorized vehicle to occupy said parking stall without said warning signal being provided, said selective disarming and rearming means including means for generating an input initiated by selectively possessed identification means, and a timer associated with one of said detector means and said providing means for providing a time delay after one of said presence detection and before said providing of said warning signal, thereby to provide an authorized user sufficient time to move between the authorized vehicle and the monitor to disarm/rearm the monitor without said warning signal being provided.

* * * * *